US006762728B2

(12) United States Patent
Koyama et al.

(10) Patent No.: US 6,762,728 B2
(45) Date of Patent: Jul. 13, 2004

(54) ANTENNA DEVICE FOR HIGH-FREQUENCY RADIO APPARATUS AND WRIST WATCH-TYPE RADIO APPARATUS

(75) Inventors: Shunsuke Koyama, Chino (JP); Teruhiko Fujisawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/980,152

(22) PCT Filed: Mar. 29, 2001

(86) PCT No.: PCT/JP01/02662

§ 371 (c)(1),
(2), (4) Date: Nov. 27, 2001

(87) PCT Pub. No.: WO01/73889

PCT Pub. Date: Oct. 4, 2001

(65) Prior Publication Data

US 2002/0163473 A1 Nov. 7, 2002

(30) Foreign Application Priority Data

Mar. 29, 2000 (JP) ..... 2000-92494

(51) Int. Cl.[7] ..... H01Q 1/12

(52) U.S. Cl. ..... 343/718; 343/700 MS; 343/848

(58) Field of Search ..... 343/700 MS, 702, 343/718, 828, 846, 848, 829

(56) References Cited

U.S. PATENT DOCUMENTS

| | | | | | |
|---|---|---|---|---|---|
| 4,864,320 | A | * | 9/1989 | Munson et al. | 343/833 |
| 4,884,252 | A | * | 11/1989 | Teodoridis et al. | 368/10 |
| 5,329,501 | A | * | 7/1994 | Meister et al. | 368/10 |
| 5,530,919 | A | * | 6/1996 | Tsuru et al. | 455/575.5 |
| 5,550,554 | A | | 8/1996 | Erkocevic | 343/828 |
| 5,764,189 | A | | 6/1998 | Lohninger | 343/700 MS |
| 5,832,372 | A | * | 11/1998 | Clelland et al. | 455/115 |
| 5,886,669 | A | * | 3/1999 | Kita | 343/718 |
| 5,914,693 | A | | 6/1999 | Takei et al. | 343/767 |
| 5,926,144 | A | | 7/1999 | Bolanos et al. | 343/718 |
| 6,025,805 | A | * | 2/2000 | Smith et al. | 343/702 |
| 6,130,650 | A | * | 10/2000 | Curtis et al. | 343/846 |
| 6,373,439 | B1 | * | 4/2002 | Zurcher et al. | 343/718 |

FOREIGN PATENT DOCUMENTS

| | | |
|---|---|---|
| EP | 0 742 604 A2 | 11/1996 |
| EP | 0 757 405 A1 | 2/1997 |
| EP | 0 806 810 A2 | 11/1997 |
| EP | 0 851 533 A1 | 7/1998 |
| EP | 0 742 604 A3 | 1/1999 |
| JP | 3-175826 | 7/1991 |
| JP | 5-22018 | 1/1993 |
| JP | 6-334421 | 12/1994 |
| JP | 7-288415 | 10/1995 |
| JP | 09-232857 | 9/1997 |
| JP | 10-41741 | 2/1998 |
| JP | 10-261914 | 9/1998 |
| JP | 11-74722 | 3/1999 |

* cited by examiner

*Primary Examiner*—Shih-Chao Chen
(74) *Attorney, Agent, or Firm*—Mark P. Watson

(57) ABSTRACT

An antenna device for a high frequency radio apparatus is equipped with an antenna element which is placed on a circuit board whose peripheral shape has a curve. The antenna element also follows the peripheral shape of the circuit board to have a curved part when viewed from above. The antenna device also has a ground pattern where the antenna element touches. The ground pattern can be placed at a constant distance from the antenna element toward the board. Furthermore, the ground pattern can be formed on almost the entire area of the circuit board other than where the antenna element is formed. Also, the circuit board may be a multilayer circuit board, and the ground pattern can be formed almost on the entire area of any one layer of the multilayer circuit board other than where the antenna element is formed.

21 Claims, 15 Drawing Sheets

ANTENNA DEVICE FOR HIGH-FREQUENCY RADIO APPARATUS AND WRIST WATCH-TYPE RADIO APPARATUS

BACKGROUND ART

The present invention relates to an antenna device for a high-frequency radio apparatus, plus a high-frequency radio apparatus and a wrist watch-type high-frequency radio apparatus in which this antenna device is installed. The present invention specifically relates to an antenna device which is utilized for a very small radio apparatus such as a wrist watch-type apparatus.

A helical dipole antenna has been commonly utilized as an antenna for a high-frequency radio apparatus such as a cellular phone.

A helical dipole antenna is designed to be either extended from or kept within the portable device case when in use.

Furthermore, as disclosed in Japanese Patent Application Laid-Open Publication No.3-175826, there is another type of antenna, an inverted-F antenna, which, when installed within a portable device case, forms a diversity with a helical dipole antenna when utilized for a high-frequency radio apparatus.

Also, a chip antenna which is made out of a ceramic material has been utilized for a thin portable apparatus of the 2.4 [GHz] band card type.

However, a helical dipole antenna as described above is still too big for an apparatus which is desired to be more compact such as a watch-size portable apparatus. Therefore, it is difficult to simply install the helical dipole antenna within a small portable apparatus case.

Also, there is little flexibility in the formation of the inverted-F antenna since the antenna element and the ground plate (main plate) are formed as integral units. Consequently, making the inverted-F antenna compact is difficult.

On the other hand, with regard to the ceramic chip antenna, the chip antenna itself can be surface-mounted, yet it is still too big to be utilized as an antenna part with a surrounding circuit. In addition, the chip antenna is costly.

Furthermore, high flexibility of antenna configuration is desired if a small radio apparatus such as a cellular phone is to be made even more compact or its external design is to be improved by taking maximum advantage of the curve.

An object of the present invention therefore is to provide a compact antenna device for a high-frequency radio apparatus, plus a high-frequency radio apparatus and a watch-shaped radio apparatus in which the antenna is installed.

DISCLOSURE OF THE INVENTION

The antenna device for a high-frequency radio apparatus is characterized by an antenna element placed on a circuit board whose peripheral shape has a curve, the antenna element following the peripheral shape of the circuit board to have a curved part when viewed from above, and a ground pattern on which the antenna element touches.

In this case, the ground pattern can be placed on the board surface at a constant distance from the antenna element. Also, the ground pattern can be formed on almost the entire area of the circuit board other than where the antenna element is formed.

Also, the circuit board can be a multilayer circuit board, and the ground pattern can be formed on almost the entire area of any one internal layer of the multilayer circuit board other than where the antenna element is formed.

Also, the extending direction of the antenna element near the connecting point of the element and the tangential direction of the ground pattern's connecting point can be more or less at right angles at the connecting point where the element is connected with the ground pattern.

Furthermore, assuming that the curved part is almost an arc when it is seen from above, the angle between the line which passes through the center of the circle, part of which forms the arc, and the connecting point where the antenna element touches the ground pattern and the straight line which passes through the tip of the antenna element and the circle center can be equal to or smaller than 180 degrees.

Also, the antenna device for a high-frequency radio apparatus is characterized by being equipped with a multilayer circuit board, an antenna element which is placed on the multilayer circuit board and a ground pattern the antenna element touches which is formed on almost the entire area of any one internal layer of the multilayer circuit board other than that on which the antenna element is formed.

Also, the antenna for a high-frequency radio apparatus is characterized by being equipped with a multilayer circuit board, an antenna element which is placed on the multilayer circuit board, a first ground pattern which is placed at a constant distance from the antenna element on the multilayer circuit board and is connected with the antenna element, and a second ground pattern which is formed throughout almost the entire area other than where the antenna element is formed within any one internal layer of the multilayer circuit board and is electrically connected with the first ground pattern.

In this case, the antenna element is the inverted-F antenna, and the element length can be approximately a quarter wave length of the designated radio frequencies.

Also, a high frequency radio apparatus is characterized by being equipped with an antenna part for a high frequency radio apparatus having an antenna element which is placed on a circuit board whose peripheral shape has a curve, the antenna element following the peripheral shape of the circuit board to have a curved part when viewed from above, and a ground pattern where the antenna element touches, and a radio communication part where radio communication takes place via the antenna for the high frequency radio apparatus.

In this case, the ground pattern can be placed at a constant distance from the antenna element toward the board surface.

Also, the ground pattern can be formed on almost the entire area of the circuit board other than where the antenna element is formed.

Furthermore, the circuit board can be a multilayer board, and the ground pattern can be formed on almost the entire area of any one layer of the multilayer circuit board other than where the antenna element is formed.

Also, a high frequency radio apparatus is characterized by being equipped with an antenna part for the high frequency radio apparatus comprising a multilayer circuit board, an antenna element which is placed on the multilayer circuit board, and a ground pattern where the antenna element touches which is formed on almost the entire area of any one layer of the multilayer circuit board other than where the antenna element is formed, and a radio communication part where radio communication takes place through the antenna part for the high frequency radio apparatus.

In this case, the radio communication part is equipped with a plurality of elements including a power supply, and among these plural elements, those which affect characteristics of the antenna part for the high frequency radio apparatus by being placed near the antenna part for the high frequency radio apparatus, can be placed on the circuit board by utilizing the ground pattern as the projecting plane and letting the orthogonal projection of the peripheral configuration of these elements fit in the projecting plane when elements are viewed from above.

Also, a high frequency radio apparatus is characterized by being equipped with an antenna part for a high frequency radio apparatus which contains a multilayer circuit board, an antenna element which is formed on the multilayer circuit board, a first ground pattern which is placed at a constant distance from the antenna element on the multilayer circuit board toward the board and is connected with the antenna element, and a second ground pattern which is electrically connected with the first ground pattern and is formed on almost the entire area of any one layer of the multilayer circuit board other than where the antenna element is formed, and a radio communication part where radio communication takes place through the antenna for the high frequency radio apparatus.

In this case, the radio communication part is equipped with plural elements including a power supply, and those plural elements which affect characteristics of the antenna for the high frequency radio apparatus due to their proximity to the antenna can be placed on the circuit board by utilizing the second ground pattern as the projecting plane and letting the orthogonal projection of the peripheral configuration of elements fit in the projecting plane when elements are viewed from above.

Also, a wrist watch-type high frequency radio apparatus is characterized by being equipped with an antenna part for the high frequency radio apparatus with an antenna element placed on a circuit board along the peripheral configuration of the circuit board whose peripheral configuration contains some curves when it is viewed from above along with a ground pattern where the antenna element touches, a radio communication part by which radio communication takes place through the antenna part for the high frequency radio apparatus and a wrist watch-type case in which the antenna part for the high frequency radio apparatus and the radio communication part are stored.

In this case, the ground pattern can be placed at a constant distance from the antenna element toward the board.

Also, the ground pattern can be formed on almost the entire area of the circuit board other than where the antenna element is formed.

Furthermore, the circuit board can be a multilayer circuit board, and the ground pattern can be formed on almost the entire area of any one layer of the multilayer circuit board other than where the antenna element is formed.

Also, a wrist watch-type high frequency radio apparatus is characterized by being equipped with an antenna part for the high frequency radio apparatus having a multilayer circuit board, an antenna element which is placed on the multilayer circuit board, and a ground pattern which is formed on almost the entire area of any one layer of the multilayer circuit board other than where the antenna element is formed, a radio communication part where radio communication takes place through the antenna for the high frequency radio apparatus, and a wrist watch-type case in which the antenna for the high frequency radio apparatus and the radio communication part are stored.

In this case, the radio communication part is equipped with plural elements including a power supply, and those elements among these plural elements which affect characteristics of the antenna part for the high frequency radio apparatus due to their proximity to the antenna part for the high frequency radio apparatus, can be placed on the circuit board by utilizing the ground pattern as the projecting plane and letting the orthogonal projection of peripheral configuration of these elements fit in the projecting plane when elements are viewed from above.

Also, a wrist watch-type radio apparatus is characterized by being equipped with an antenna part for the high frequency radio apparatus having a multilayer circuit board, an antenna element which is formed on the multilayer circuit board, a first ground pattern which the antenna element touches and is placed on the multilayer circuit board at a constant distance from the antenna element toward the board, and a second ground pattern which is electrically connected with the first ground pattern and is formed on almost the entire area of any one internal layer of the multilayer circuit board other than where the antenna element is formed, a radio communication part where radio communication takes place through the antenna for the high frequency radio apparatus, and a wrist watch-type case in which the antenna for the high frequency radio apparatus and the radio communication part are stored.

In this case, the radio communication part is equipped with plural elements including a power supply, and those elements which affect characteristics of the antenna part for the high frequency radio apparatus due to their proximity to the antenna part for the high frequency radio apparatus, they can be placed on the circuit board by utilizing the second ground pattern as the projecting plane and letting the orthogonal projection of peripheral configuration of these elements fit in the projecting plane when the elements are viewed from above.

BRIEF DESCRIPTION OF THE DRAWINGS

FIG. 16 is an explanatory diagram of the third modification of the embodiments.

PREFERRED EMBODIMENTS OF THE INVENTION

With reference to the accompanying drawings, preferred embodiments of the present invention will now be described.

[1] First Embodiment

[1.1] An Antenna Device Structure of the First Embodiment

Figure 1A:
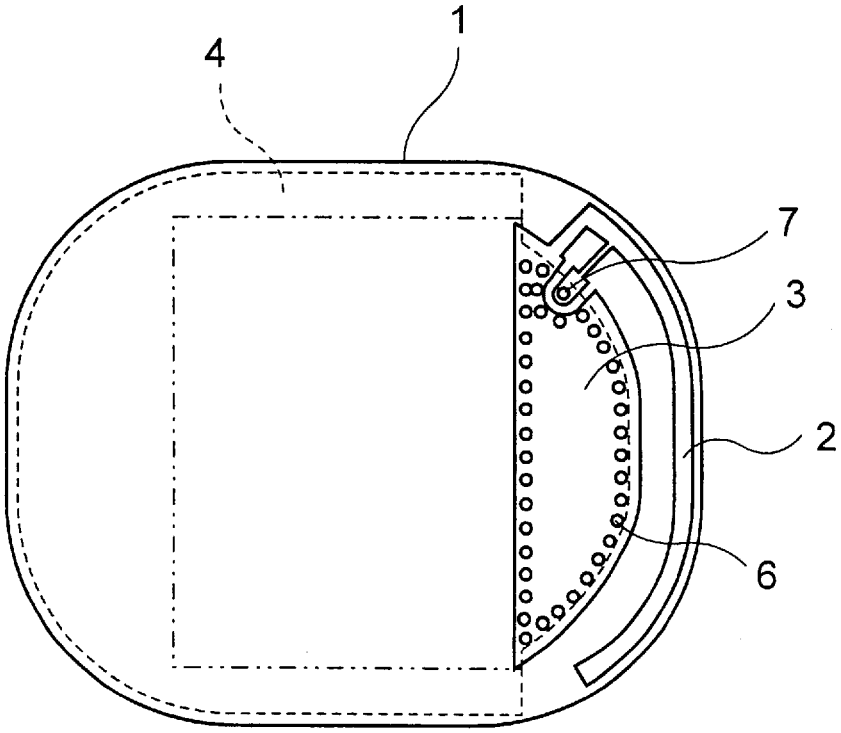
FIG. 1A shows a top view of a circuit board of the watch-shaped radio apparatus of the first embodiment.
Figure 1C:
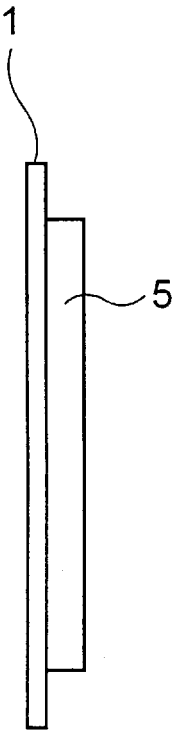
FIG. 1C shows a side view of a circuit board of the watch-shaped radio apparatus of the first embodiment.
Figure 1B:
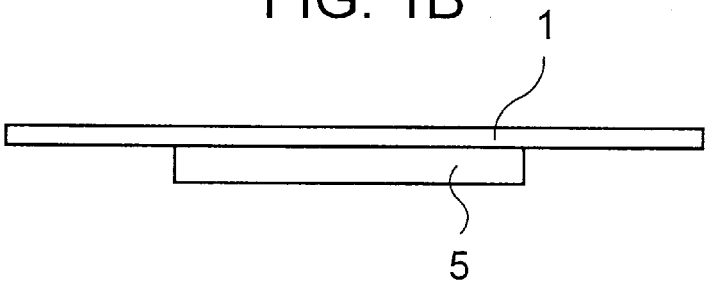
FIG. 1B shows a front view of a circuit board of the watch-shaped radio apparatus of the first embodiment.

FIG. 1A is a ground plan of the circuit board of the watch-shaped radio apparatus of the first embodiment. FIG. 1B is a front view of the circuit board of the watch-shaped radio apparatus of the first embodiment. FIG. 1C is a side view of the circuit board of the watch-shaped radio apparatus of the first embodiment.

Circuit board 1 is formed as a multilayer board. The external configuration of circuit board 1 is partially curved.

On the top layer (surface layer) of multilayer circuit board 1, antenna element 2 is formed as a pattern of slow curves.

On the same layer where antenna element 2 of circuit board 1 is formed, ground pattern 3 is formed along antenna element 2.

Also, on a different layer (internal layer) which is not the same as the one where antenna element 2 of circuit board 1 is formed, second ground pattern 4 which is electrically connected with ground pattern 3 by means of through hole 6 is formed.

Furthermore, on the other side (hereinafter referred to as bottom side) of the side on which antenna element 2 of circuit board 1 is formed (hereinafter referred to as top side), radio circuit 5 is formed. Radio circuit 5 is placed as a module for the sake of illustration concision in FIG. 1A, FIG. 1B and FIG. 1C, but it is also possible to configure radio circuit 5 by mounting it on the bottom side of circuit board 1 after making wiring pattern thereon.

In this case, only antenna element 2 and ground pattern 3 are shown on circuit board 1; however, the liquid crystal display device to display information, display driver 1C to drive the liquid crystal display device, the micro processor unit (MPU) to control each part and some surrounding parts for the microprocessor are also incorporated. Each of these parts which forms the wrist watch-type radio apparatus is connected by wiring pattern on circuit board 1.

Antenna element 2 is formed with some curves along the external configuration of circuit board 1 as shown in FIG. 1A. It has a right-angled shape at one end of where it is connected with ground pattern 3.

Ground pattern 3 is designed to have a constant space along the configuration of antenna element 2. The space between antenna element 2 and ground pattern 3 is determined by taking into account the antenna's characteristics and the board size. Specifically, the space is approximately 2 [mm].

The length of antenna element 2 is set for approximately a quarter of a radio wave taking into account of the wave length reduction effect by the dielectric constant of circuit board 1 and a dielectric (e.g. plastic parts) which is placed near antenna element 2. Specifically, it is set for more or less 20 and several [mm] in case of a 2.4 [GHz] band such as an ISM band.

The purpose of feeding point 7 is to supply antenna element 2 with power. The connecting point of feeding point 7 is determined by taking into account the impedance matching between antenna element 2 and the feeding circuit which is not shown. In FIG. 1A, the connecting line between feeding point 7 and the feeding circuit and so forth are omitted for the sake of concision. Also, feeding power into antenna element 2 via through hole from the inside of circuit board 1 is possible.

In this case, antenna element 2, ground pattern 3, ground pattern 4 and feeding point 7 form a quarter wave length inverted-F antenna.

The size of ground pattern 3 is limited due to the restriction caused by the mounting of the circuit parts which is stated above. However, it is desirable to form ground pattern 4 on the entire area of at least one layer of circuit board 1 except for the top layer where antenna element 2 is formed as shown in FIG. 1A.

[1.2] Effects of the First Embodiment

Figure 2A:
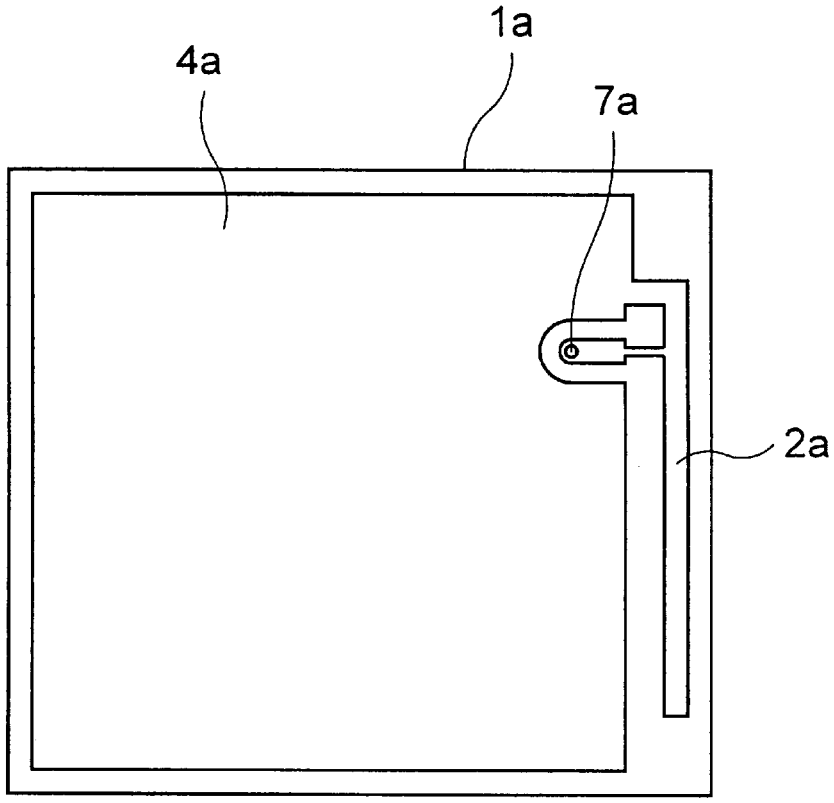
FIG. 2A shows a top view of a circuit board of a watch-shaped radio apparatus of the prior art.
Figure 2B:
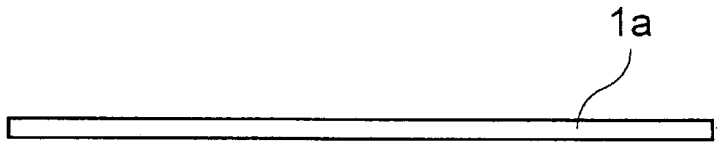
FIG. 2B shows a front view of a circuit board of the watch-shaped radio apparatus of the prior art.

Shown in FIG. 2A is a top view of the circuit board for the watch-shaped radio apparatus of the prior art. Shown in FIG. 2B is a front view of the circuit board of the watch-shaped radio apparatus of the prior art.

The major part of antenna element 2*a* of the inverted-F antenna of the prior art is formed like a straight line as one pattern of the inverted-F antenna shown in FIG. 2A. Also, ground pattern 4*a* is rectangular. As a result, there was a problem that the board size was bigger than a quarter of the wavelength.

Also, mounting other parts on the board is impossible since ground pattern 4A and antenna element 2A are formed on the same layer (the top layer) of the board. Therefore, it was impossible to take advantage of the board area effectively.

On the other hand, according to the configuration of the first embodiment, antenna element 2 is formed as a non-straight line along the periphery of circuit board 1. Consequently, the size of circuit board 1 can be made smaller.

Also, second ground pattern 4 is formed within the internal layer of circuit board 1 which is different from where antenna element 2 is formed. As a result, the area of first ground pattern 3 which is formed on the board surface can be made smaller. Also, placing some parts on the board surface becomes possible. Hence, the board surface area can be utilized more effectively, and a further reduction in size becomes possible.

Figure 3A:
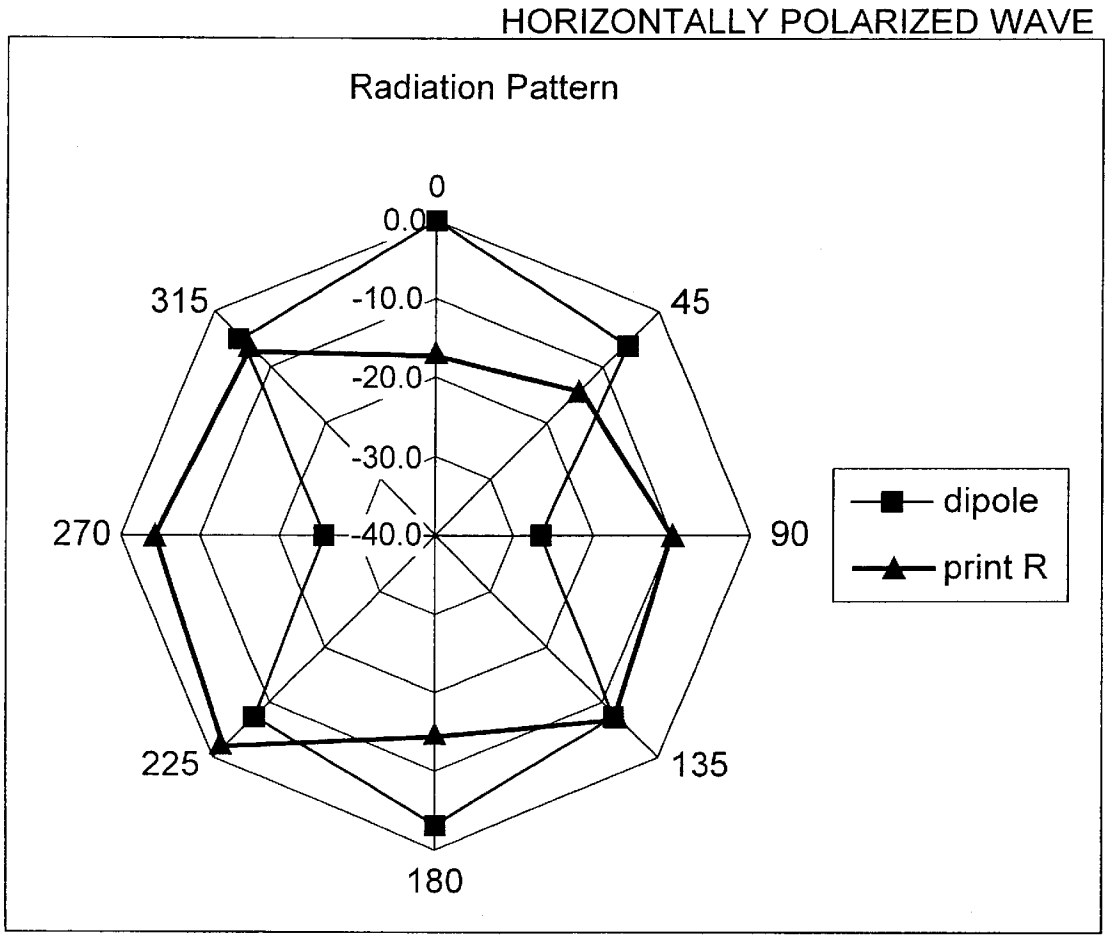
FIG. 3A shows an example of a radiation pattern of horizontally polarized wave direction of the inverted-F antenna of the first embodiment on a horizontal plane.
Figure 3B:
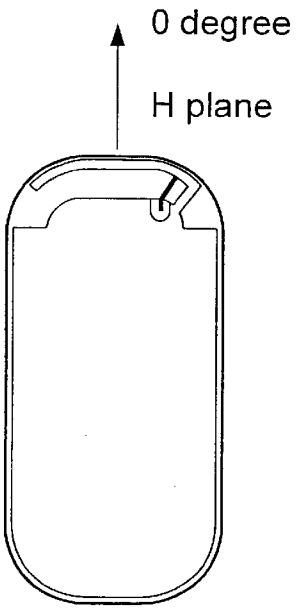
FIG. 3B explains how the circuit board of the wrist watch-type radio apparatus is placed during the radiation pattern calibration for FIG. 3A.
Figure 3C:
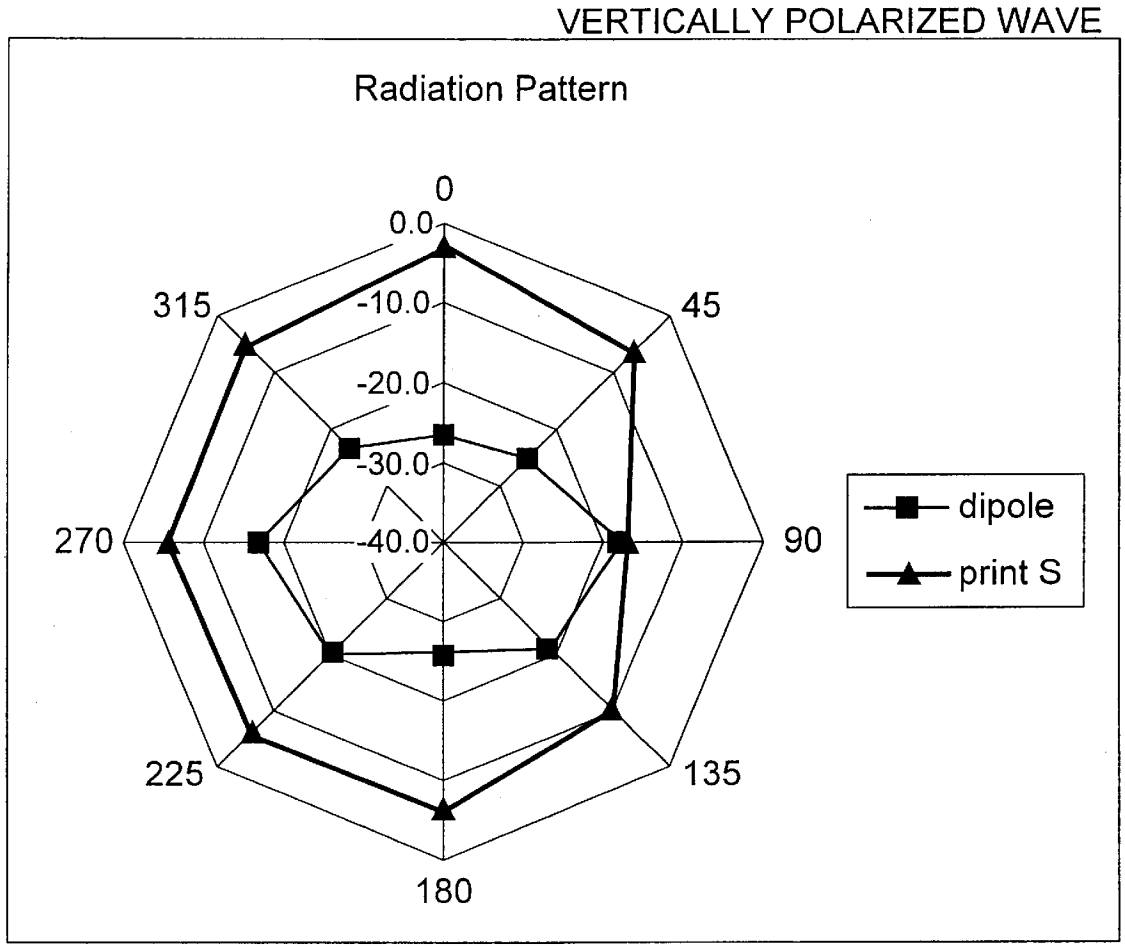
FIG. 3C shows an example of a radiation pattern of vertically polarized wave direction of the inverted-F antenna of the first embodiment on a perpendicular plane.
Figure 3D:
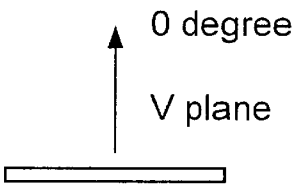
FIG. 3D explains how the circuit board of the wrist watch-type radio apparatus is placed during the radiation pattern calibration for FIG. 3C.
Figure 4A:
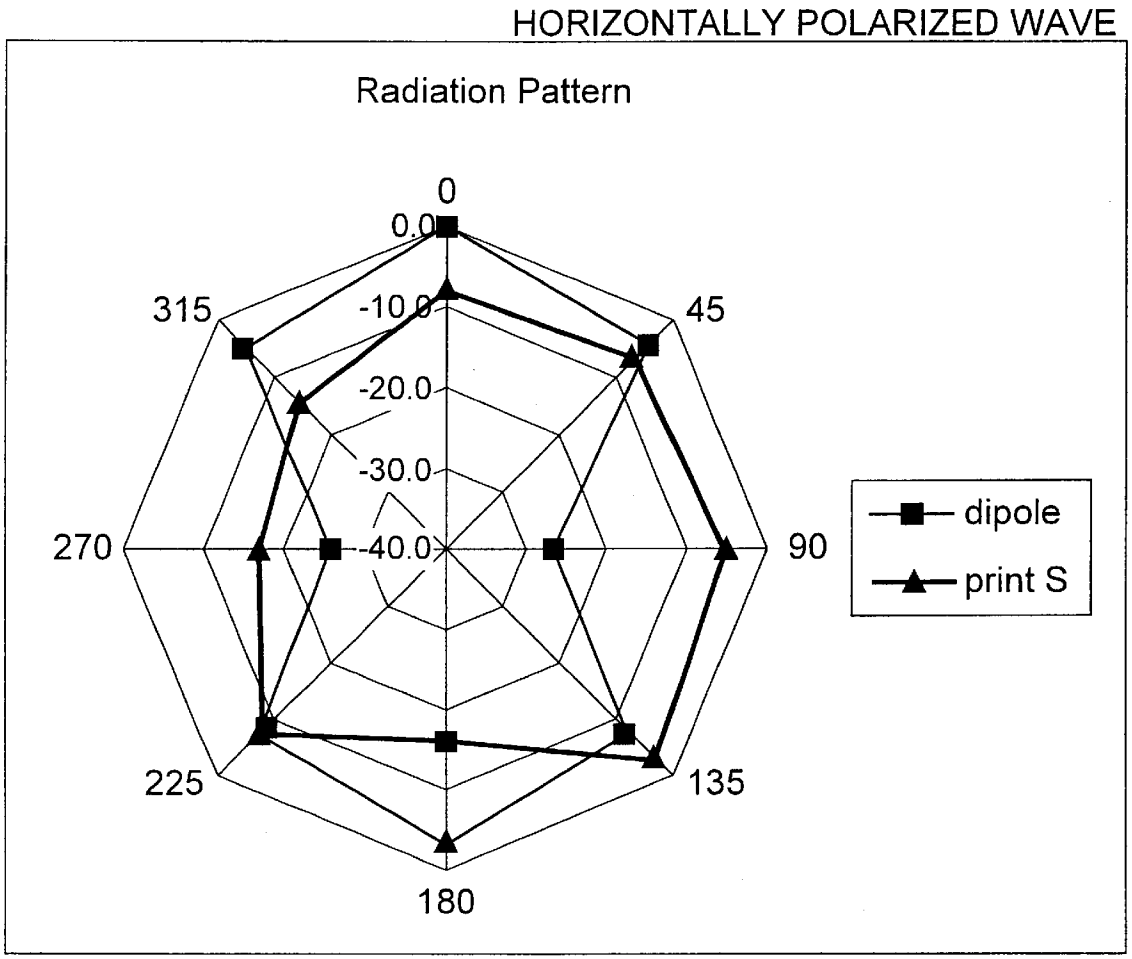
FIG. 4A shows an example of a radiation pattern of horizontally polarized wave direction of the inverted-F antenna of the prior art on a horizontal surface.
Figure 4B:
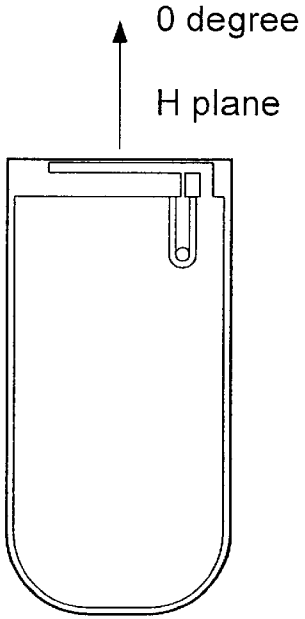
FIG. 4B explains how the circuit board of the wrist watch-type radio apparatus is placed during the radiation pattern calibration for FIG. 4A

Shown in FIG. 3A is an example of a radiation pattern of the horizontally polarized wave direction on a horizontal plane during the calibration in which the inverted-F antenna of the wrist watch-type radio apparatus of the first embodiment is placed toward the direction shown in FIG. 3B. Also, shown in FIG. 3C is an example of a radiation pattern of the vertically polarized wave direction on a vertical plane during the calibration in which the inverted-F antenna of the wrist watch-type radio apparatus of the first embodiment is placed toward the direction shown in FIG. 3D. Also, shown in FIG. 4A is an example of a radiation pattern of the horizontally polarized wave direction on a horizontal plane during the calibration in which the inverted-F antenna of the wrist watch-type radio apparatus of the prior art is placed toward the direction shown in FIG. 4B. Also, shown in FIG. 4.C is an example of a radiation pattern of the vertically polarized wave direction on a vertical plane during the calibration in which the inverted-F antenna of the wrist watch-type radio apparatus of the prior art is placed toward the direction displayed in FIG. 4D. Some characteristics of the half wave dipole antenna at the same frequency are shown in FIG. 3A, FIG. 3C, FIG. 4A, and FIG. 4C for comparison. The unit is in dipole ratio gain (dBd).

As can be seen in FIG. 3A, the inverted-F antenna of the first embodiment has a radiation pattern whose direction of the maximum gain is almost 90 degrees different from the direction of the half wave dipole antenna's maximum gain. Also, gain decrease in the null point (the point where the gain decreases sharply) which appears at approximately 90[°] from the direction of the maximum gain is smaller in the inverted-F antenna of the first embodiment than in the half wave dipole antenna.

On the other hand, in the inverted-F antenna of the prior art shown in FIG. 4A, the characteristics of the radiation pattern are somewhat distorted, and the gain at 270[°] direction is low.

Figure 4C:
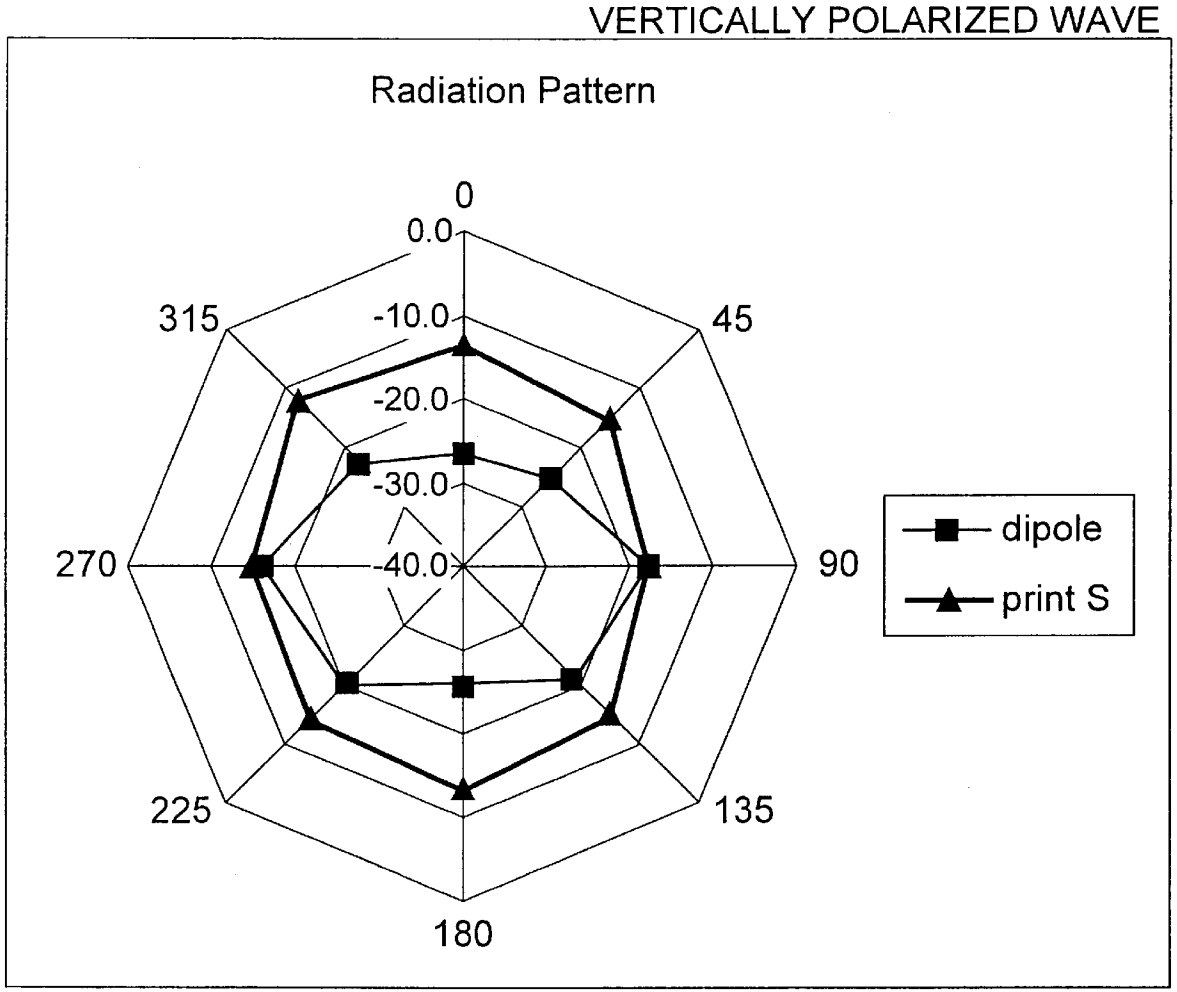
FIG. 4C shows an example of a radiation pattern of vertically polarized wave of the inverted-F antenna of the prior art on a perpendicular plane.
Figure 4D:
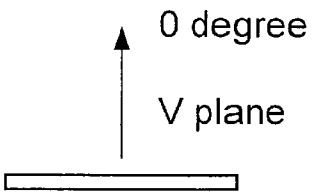
FIG. 4D explains how the circuit board of the wrist watch-type radio apparatus is placed during the radiation pattern calibration for FIG. 4C.

Also, as can be seen by comparing FIG. 3C and FIG. 4C, the antenna gain is high in the radiation patterns of the vertically polarized wave on the perpendicular, and its characteristics are excellent.

Consequently, characteristics of the inverted-F antenna of the first embodiment are closer overall to the half wave dipole antenna than those of the inverted-F antenna of the prior art; therefore, it can be easily handled as an antenna.

[2] Second Embodiment

The second embodiment of this antenna is different from the first embodiment in that the circuit board is closer to a rectangular shape than that in the first embodiment. Another difference is that only the ground pattern is formed on the plane on which the antenna element is formed.

Figure 5A:
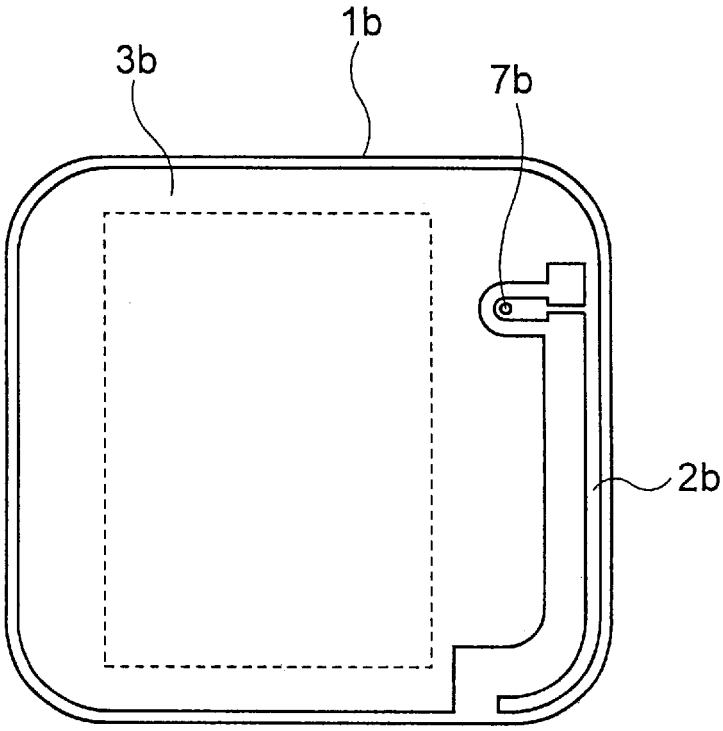
FIG. 5A shows a top view of a circuit board of the watch-shaped radio apparatus of the second embodiment.
Figure 5C:
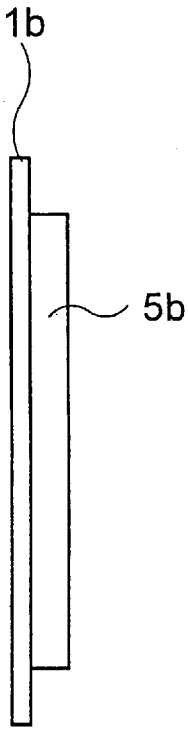
FIG. 5C shows a side view of a circuit board of the watch-shaped radio apparatus of the second embodiment.
Figure 5B:
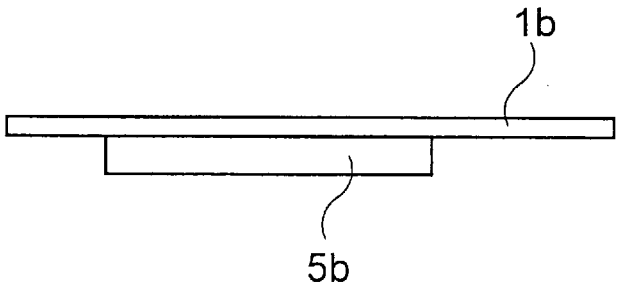
FIG. 5B shows a front view of a circuit board of the watch-shaped radio apparatus of the second embodiment.

FIG. 5A is a ground plan of the circuit board for the wrist watch-type radio apparatus of the second embodiment. Also, FIG. 5B is a front view of the circuit board for the wrist watch-type radio apparatus of the second embodiment. FIG. 5C is a side view of the wrist watch-type radio apparatus of the second embodiment.

Circuit board 1*b* is formed as a multilayer board. Its external configuration contains some curves.

Antenna element 2*b* is formed as a pattern on circuit board 1*b*, and has a gradual curve at the top.

Ground pattern 3 is formed on the same layer as circuit board 1*b* along antenna element 2*b*.

Furthermore, a wireless circuit 5*b* is formed on the opposite side of circuit board 1*b*.

The purpose of feeding point 7*b* is to supply power to antenna element 2. Its connecting point is determined by taking impedance matching between antenna element 2 and a feeding circuit which is not shown into account. The wiring pattern between feeding point 7*b* and the feeding circuit and so forth are omitted in FIG. 5A for the sake of concision. Power supply to antenna element 2 is also possible from the inside of circuit board 1*b* by means of a through hole.

[3] Third Embodiment

The third embodiment of this antenna is different from the first embodiment in that the circuit board is smaller than that of the first embodiment, and its shape is closer to an ellipse. Another difference is that only the ground pattern is formed on the plane on which the antenna element is formed.

Figure 6A:
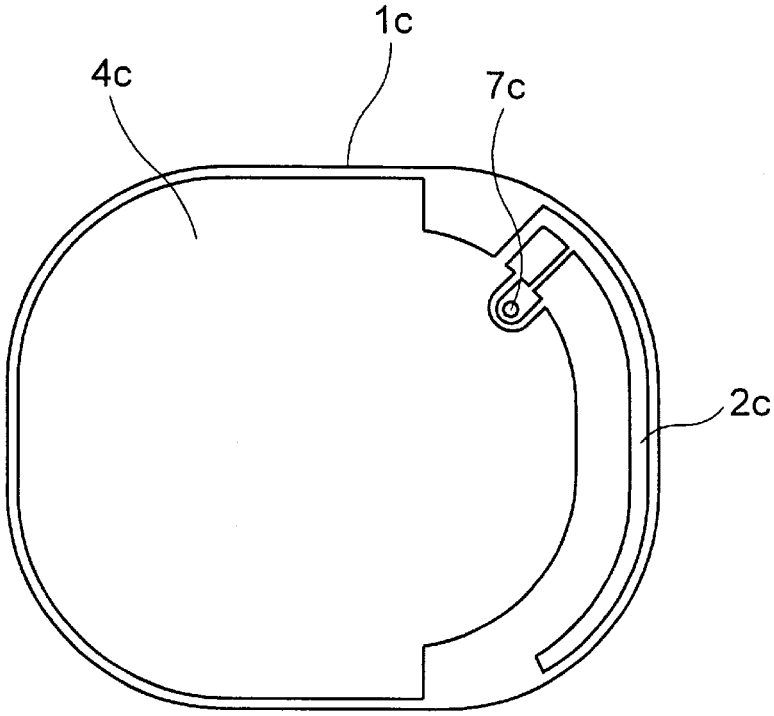
FIG. 6A shows a top view of a circuit board of the watch-shaped radio apparatus of the third embodiment.
Figure 6C:
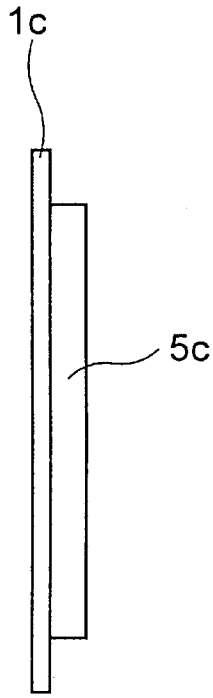
FIG. 6C shows a side view of a circuit board of the watch-shaped radio apparatus of the third embodiment.
Figure 6B:
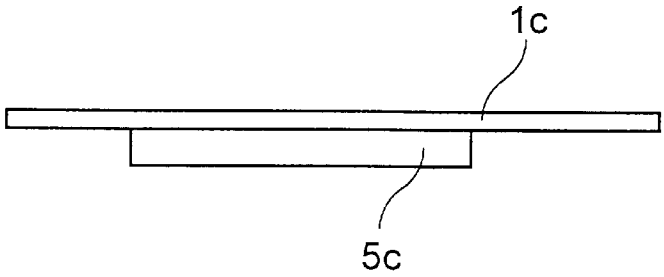
FIG. 6B shows a front view of a circuit board of the watch-shaped radio apparatus of the third embodiment.

FIG. 6A is a ground plan of the circuit board for the wrist watch-type radio apparatus of the third embodiment. FIG. 6B is a front view of the circuit board for the wrist watch-type radio apparatus of the third embodiment. FIG. 6C is a side view of the circuit board for the wrist watch-type radio apparatus of the third embodiment.

Circuit board 1*c* is formed as a multilayer board. The external configuration of circuit board 1*c* has a near-elliptic shape.

Antenna element 2*c* is formed on circuit board 1*c* as a pattern of slow curves as in the first embodiment.

Ground pattern 4*c* is formed on the same layer as circuit board 1*c* along antenna element 2*c*.

Furthermore, a wireless circuit 5*c* is formed on the opposite side of circuit board 1*c*.

The purpose of feeding point 7*c* is to supply power to antenna element 2*c*. Its connecting point is determined by taking impedance matching between antenna element 2*c* and the feeding circuit which is not shown into account. Now, the wiring pattern between feeding point 7*c* and the feeding circuit and so forth are omitted for the sake of concision in FIG. 6A.

[4] Fourth Embodiment

Figure 7:
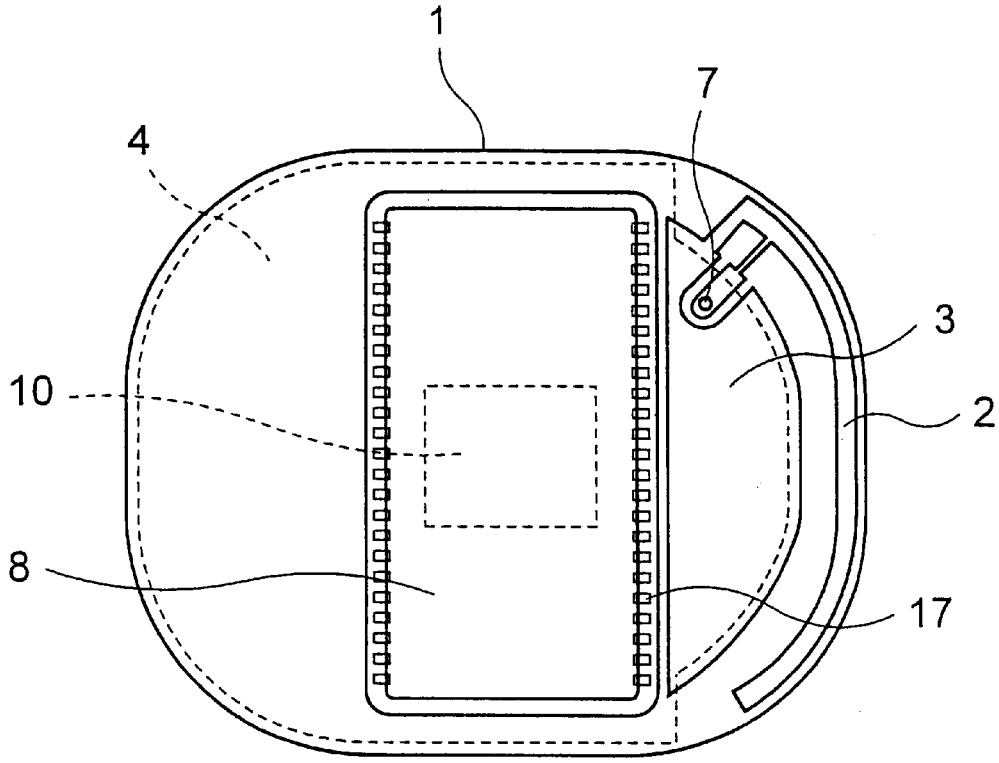
FIG. 7 is a ground plan of a module of the watch-shaped radio apparatus of the fourth embodiment.

Shown in FIG. 7 is a ground plan of the wrist watch-type radio apparatus module in which the antenna device of the fourth embodiment is installed. Also, shown in FIG. 8 is a schematic cross section of the wrist watch-type radio apparatus of FIG. 7.

Figure 8:
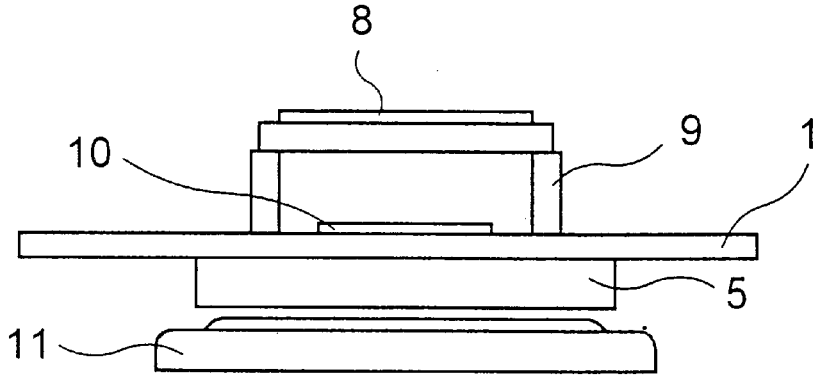
FIG. 8 is a schematic cross-section diagram of the module of the watch-shaped radio apparatus of the fourth embodiment.
Figure 1:
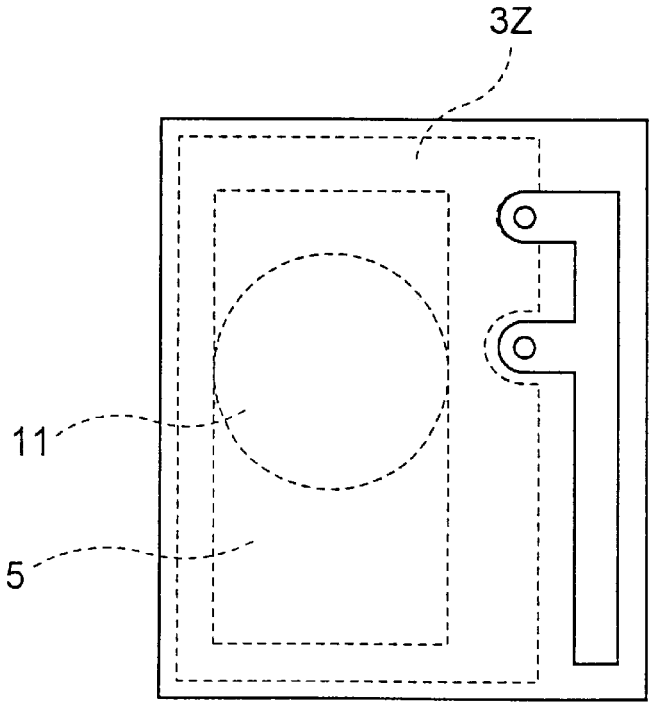

In FIG. 7 and FIG. 8, the same mark is used on the parts which overlap with those in the first embodiment in FIG. 1.

Antenna element 2 is formed as a pattern of slow curves on circuit board 1 which makes up wrist watch-type radio apparatus module E4.

Ground pattern 3 is formed on the same layer as circuit board 1 along antenna element 2.

Figure 9:
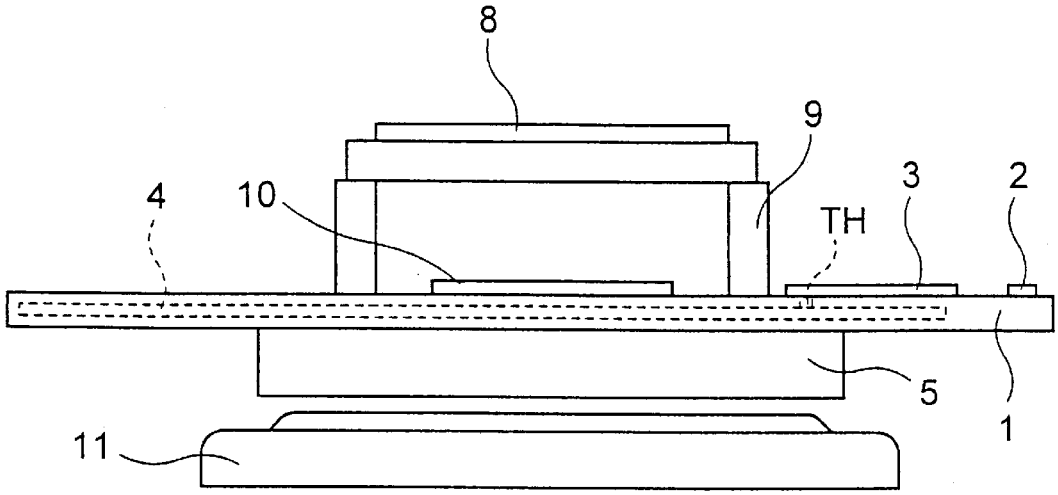
FIG. 9 is a front perspective diagram of the module of the watch-shaped radio apparatus of the fourth embodiment.

Shown in FIG. 9 is a side view of wrist watch-type radio apparatus module E4.

As shown in FIG. 9, second ground pattern 4 which is connected to ground pattern 3 by means of through hole TH is formed on another internal layer of circuit board 1.

Furthermore, control IC10 which contains the driving circuit for the liquid crystal display is installed on the top of circuit board 1. Also, a wiring pattern to send driving signals to control IC 10 is installed.

Liquid crystal display (LCD) 8, which is driven by a driving signal from control IC 10 through conductive rubber 9 and pins 17 (shown in FIG. 7), is installed on the top of control IC 10.

Also, circuit module 5 and button-type battery 11 which supplies power are placed on the opposite side of circuit board 1 of the wrist watch-type radio apparatus module. In this case, the projected area of button-type battery 11 to circuit board 1 should be smaller than the area of ground pattern 4. Also, the size and the placement of button-type battery 11 should be adjusted so as to allow its projected figure to circuit board 1 to fit in ground pattern 4.

More generally, some elements including a power supply such as button-type battery 11 and the circuit module which affect characteristics of the antenna device for a high-frequency radio apparatus due to their proximity to the antenna element should be handled as follows. Assuming that the ground pattern (in the above example, ground pattern 4) is the projecting plane, elements which affect the antenna's characteristics should be placed on the circuit board in order to have orthogonal projection of their external shape of the elements fit in the projecting plane when elements are viewed from direction perpendicular to the projecting plane.

This is because the conductive plane which is placed near and parallel to antenna elements reduces the sensitivity of a wire antenna such as a dipole antenna. Therefore, conductive parts such as metals should be placed apart from antenna elements where possible.

As a result, the structure is such that conductive parts such as metals are not placed on the corresponding place of antenna element 2 by choosing the size and the placement of button-type battery 11. Therefore, the antenna's characteristics can be improved.

Figure 10:
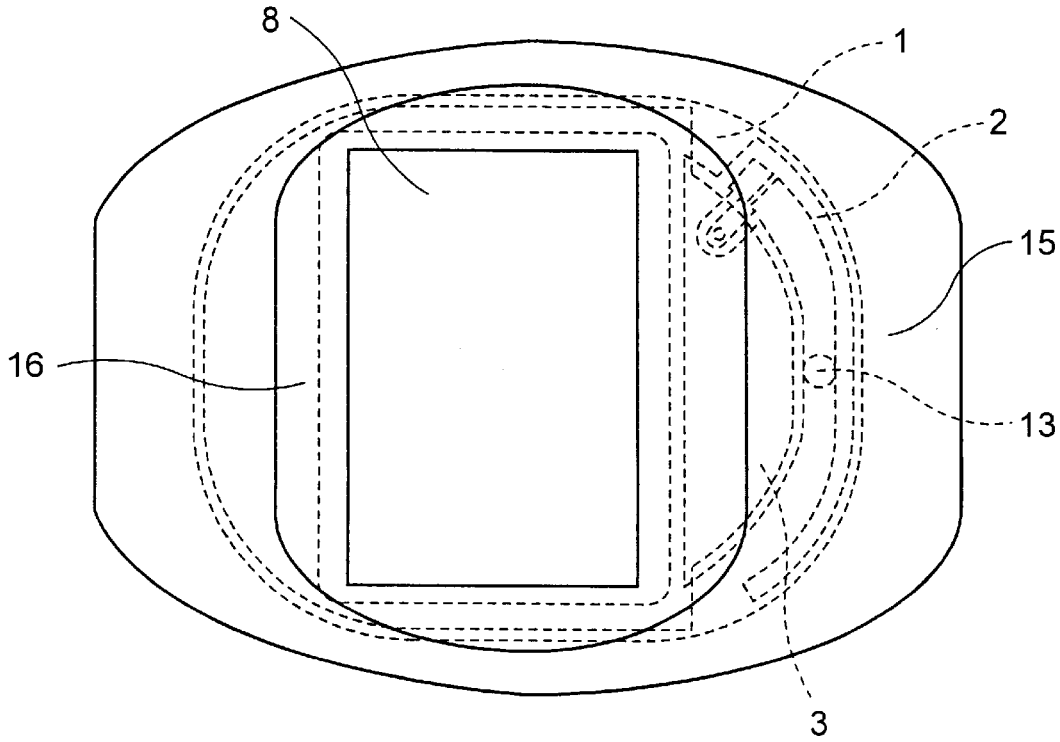
FIG. 10 is a perspective diagram of the watch-shaped radio apparatus of the fourth embodiment when the circuit board of the watch-shaped radio apparatus is placed in its case.
Figure 11:
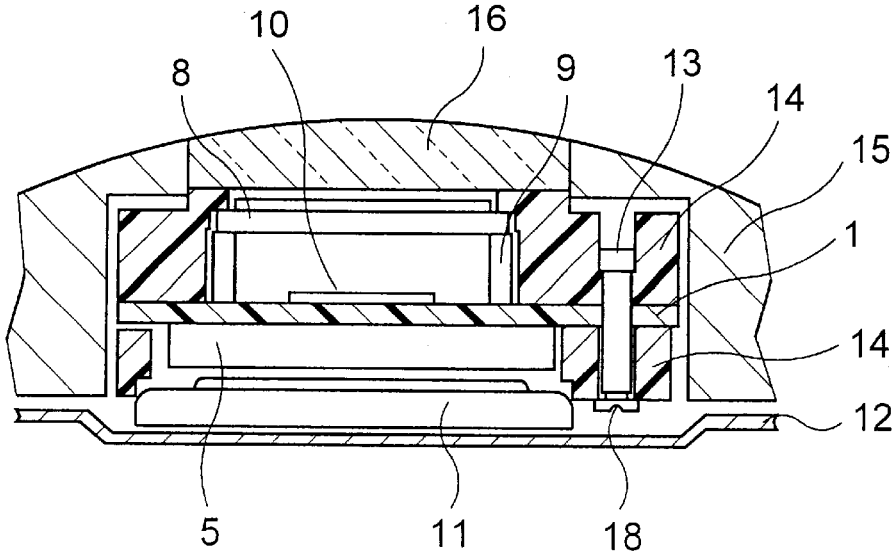
FIG. 11 is a partial cross section diagram of the watch-shaped radio apparatus of the fourth embodiment when the circuit board of the watch-shaped radio apparatus is placed in its case.

FIG. 10 is a plane perspective diagram of the wrist watch-type radio apparatus which is formed by fitting its module into its case. FIG. 11 is a cross section drawing of the wrist watch-type radio apparatus module of the fourth embodiment which is fitted into its case.

Both the top and the bottom of circuit board 1 are covered by fixing parts 14 which are made out of plastic, and wrist watch-type radio apparatus module E4 is fixed with micro-screw 18 and nut 13 within plastic case 15 which contains cover glass 16 which is made out of either plastic or inorganic glass. On the opposite side of wrist watch-type radio apparatus module E4, a back cover 12 is fixed to plastic case 15.

In this case, nut 13 is fixed at a spot where the pattern is not formed between antenna element 2 and ground pattern 3 as shown in FIG. 10. Configurations of antenna element 2 and ground pattern 3 do not need to be altered when fixing nut 13 in this position. Consequently, wrist watch-type radio apparatus module E4 which is a structure part can be attached easily.

Now, fixing parts 14 and case 15 are placed near antenna element 2 on circuit board 1. They, therefore, affect resonance frequencies of the antenna element as dielectrics.

Therefore, appropriate lengths of antenna elements need to be determined by taking the influence of these dielectrics into account. Lengths of antenna elements can actually be shortened by placing these dielectrics near antenna elements, thereby allowing an even smaller antenna device.

Also, circuit module 5 and button-type battery 11 are placed on the opposite side to ground pattern 4 on circuit board 1. In other words, they are placed within a projected area of ground pattern 4. This helps to decrease influence on antenna element 2.

Furthermore, back cover 12 should be formed out of nonmetallic materials for the same reason mentioned above as placement of circuit module 5 and button-type battery 11. Selecting appropriate materials is possible by taking the thickness of the device and waterproofing properties into account. Even in this case, desired lengths of antenna elements should be determined by taking into account the influence of the materials of which back cover 12 is comprised.

Figure 12:
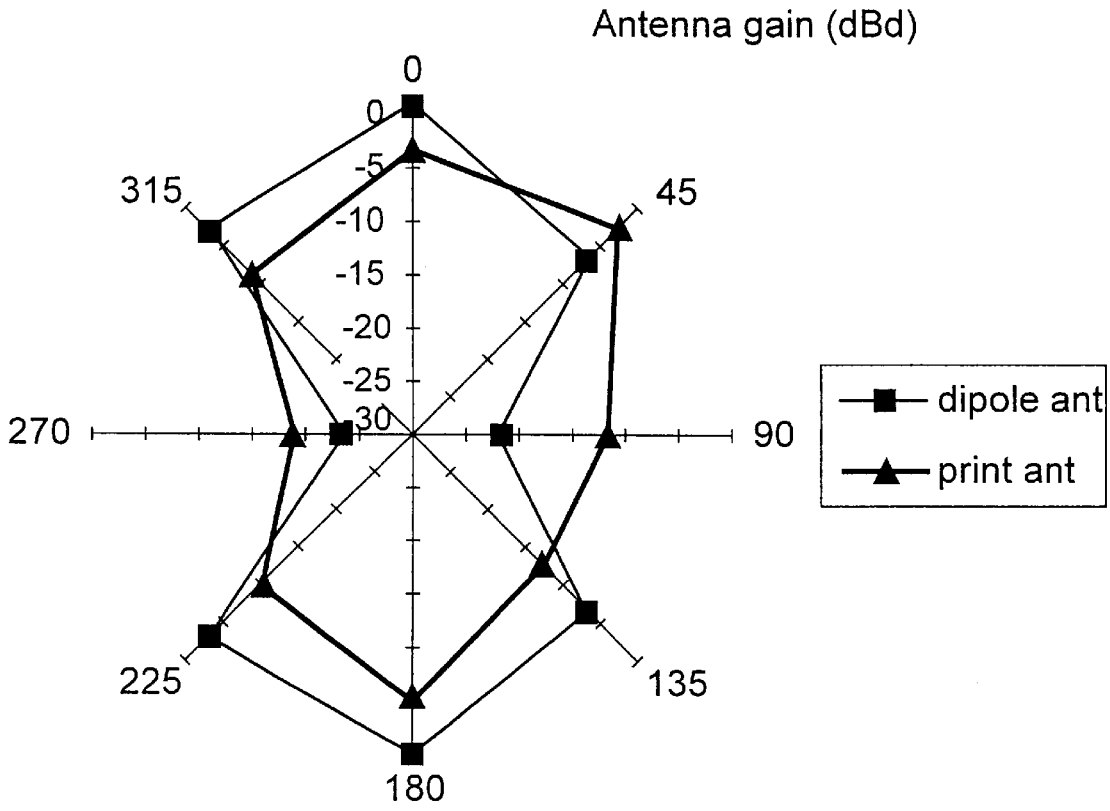
FIG. 12 shows an example of characteristics of the inverted-F antenna's radiation pattern of the fourth embodiment.

Shown in FIG. 12 is an example of a radiation pattern of the inverted-F antenna which is installed in the wrist watch-type radio apparatus of the fourth embodiment. The characteristics of the half wave dipole antenna at the same frequency are also shown in FIG. 12 for comparison. The unit is in dipole ratio gain (dBd).

As shown in FIG. 12, dipole ratio gains are above −7 dBd in every direction. This means that characteristics of a print antenna of the fourth embodiment are adequate.

[5] Fifth Embodiment

In the above embodiments, a print antenna is formed on a circuit board; however, in the fifth embodiment a print antenna is formed on a flexible board, and the flexible board is installed on the circuit board perpendicularly.

Figure 13A:
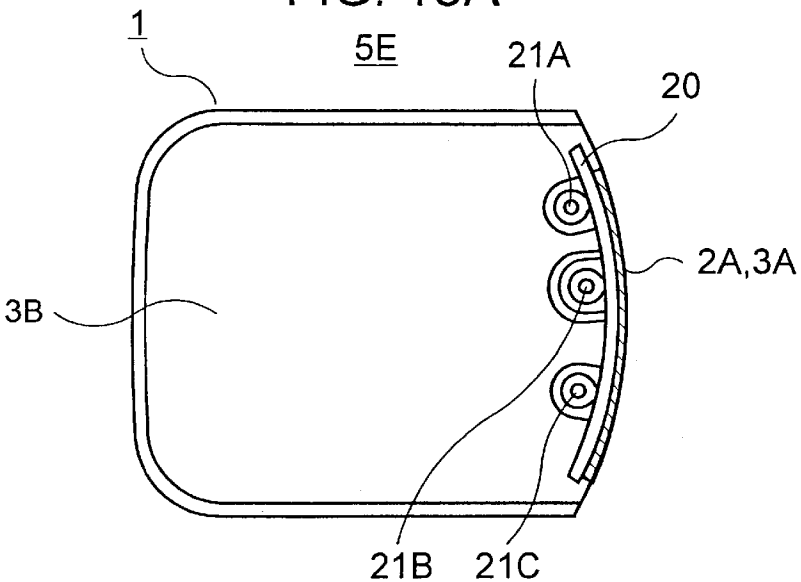
FIG. 13A shows a top view of the circuit board of the watch-shaped radio apparatus of the fifth embodiment.
Figure 13B:
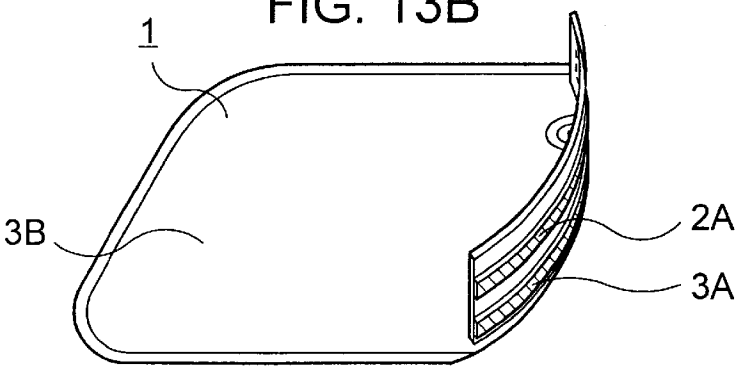
FIG. 13B shows a perspective view of the circuit board of the watch-shaped radio apparatus of the fifth embodiment.

Shown in FIG. 13A is a top view of the wrist watch-type radio apparatus module of the fifth embodiment. Shown in FIG. 13B is a figure of an oblique perspective of the wrist watch-type radio apparatus module of the fifth embodiment.

Flexible board 20 is installed perpendicularly on circuit board 1 which makes up wrist watch-type radio module 5E. This flexible board 20 is fixed so as to allow it to curve (to follow an arc) along the periphery of circuit board 1.

Figure 13C:
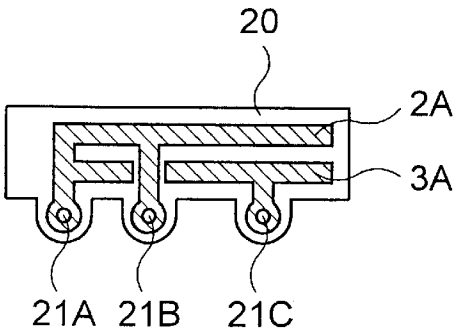
FIG. 13C shows the flexible board of the fifth embodiment.

Antenna element 2A and ground pattern 3A are formed on flexible board 20 as shown in FIG. 13C.

First ground terminal 21A which is connected with ground pattern 3B on circuit board 1, and feeding terminal 21B which is connected with a feeding point which is not shown on circuit board 1, are formed in a wiring pattern of antenna elements.

Furthermore, second ground terminal 21C which is connected with ground pattern 3B on circuit board 1 is installed on ground pattern 3A.

Since antenna element 2A is placed perpendicularly to circuit board 1, the area of the top plane of circuit board 1 can be utilized effectively.

[6] Modifications of the Embodiments

First Modification

Directivity could not be changed in either the wrist watch-type antenna module of the prior art or the dipole antenna which are shown in FIG. 2A, so the purpose of this modification is to solve this problem.

Figure 14:
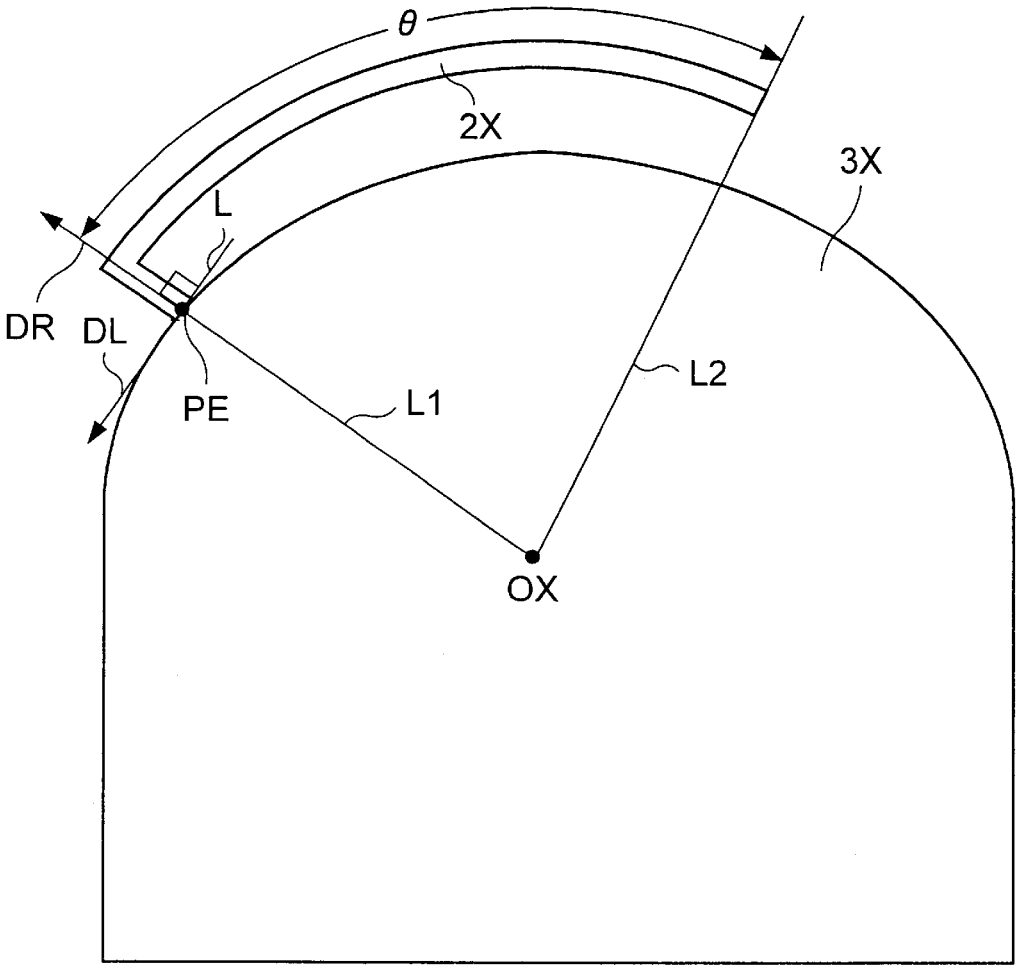
FIG. 14 is an explanatory diagram of the first modification of the embodiments.

FIG. 14 shows an explanatory drawing of the first modification of the embodiments.

With regard to each embodiment above, an angle θ between connecting point PE of antenna element 2X and the tip of antenna element 2X along ground pattern 3X has not been described in detail.

When the curved part of antenna element 2X is assumed to be a near-arc when viewed from above, an angle θ between a straight line L1 which goes through connecting point PE where antenna element 2X is connected with ground pattern 3X and ends at circle center OX for the arc and a straight line L2 which goes through the tip of the antenna element and ends at circle center OX should be below or equal to 180[°] for optimum reception sensitivity and so forth. This is because power which is received within antenna element 2X is cancelled, and loss of reception is much greater when angle θ is equal to or above 180[°].

Now, angle θ can be equal to or above 180[°] if the loss of received power can be disregarded. In both cases, the length of antenna element 2X is determined according to a specific frequency for this particular antenna element. More specifically, it should be a quarter of the wave length of the frequency to attain optimum size and sensitivity, although it does not have to be limited thus.

Also, the angle between direction DL of a tangent L of ground pattern 3X at connecting point PE of antenna element 2X and a direction DR of extension of the antenna element near the connecting point should be more or less at right angles.

As a result, this modification allows the antenna's directivity to be adjusted to any direction. For instance, a radiation graph can be rotated between 270[°] and 90[°] as shown in FIG. 3A.

Second Modification

Figure 15:
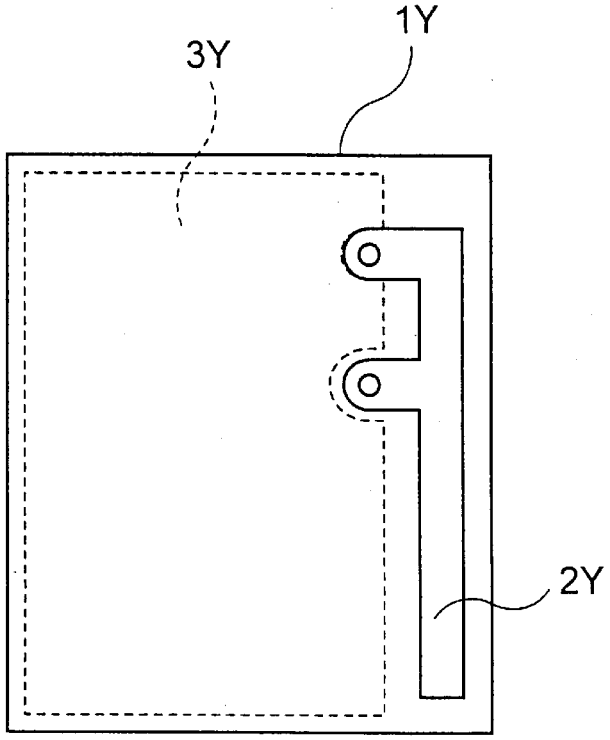
FIG. 15 is an explanatory diagram of the second modification of the embodiments.

According to the above description, the antenna element which forms the wrist watch-type antenna module contains a curve along the circuit board periphery. However, even if the antenna element contains a straight line, ground pattern 3Y can be formed within the internal layer of circuit board 1Y as shown in FIG. 15. As a result, a dielectric substance which is a circuit board lies between antenna element 2A and ground pattern 3Y, and the distance between antenna element 2Y and ground pattern 3Y can be shortened when the dielectric constant of circuit board 1Y is high, or due to the influence of the dielectric constant of the board. As a result, a reduction in size of the antenna itself becomes possible.

Third Modification

As shown in FIG. 16, when ground pattern 3Z is assumed to be a projecting plane, components which affect the antenna's characteristics, such as battery 11 and circuit module 5 are placed so that the orthogonal projection of their external configurations are cast within ground pattern 3Z, thereby preventing deterioration of the antenna's characteristics whether the configuration of the antenna element is a straight line or a curve.

Fourth Modification

The above description applies to the case when the second ground pattern is formed in one layer of the circuit board. However forming ground patterns in plural layers and regarding those plural ground patterns as secondary ground patterns is possible.

What is claimed is:

1. An antenna device for a high frequency radio apparatus comprising:

a multilayer circuit board having a curved periphery;

an antenna element formed as a pattern on a layer of the multilayer circuit board following along the periphery of the multilayer circuit board, and having a near-arc shape when viewed from above; and a ground pattern connected with the antenna element and formed in almost the entire area of any one internal layer of the multilayer circuit board other than the corresponding area that the antenna element occupies; and wherein a first line and a second line form an angle less than or equal to 180 degrees, the first line passing through the center of a circle formed in part by the near arc shape and a point where the antenna element is connected with the ground pattern, the second line passing through the center of the circle and a tip of the antenna element.

2. The antenna device for a high frequency radio apparatus of claim 1, wherein the ground pattern is formed on the multilayer circuit board a constant distance from the antenna element.

3. The antenna device for a high frequency radio apparatus of claim 1, wherein a direction along an extension of the antenna element near the point where the antenna element is connected with the ground pattern and a tangent line at a periphery of the ground pattern where the antenna element is connected with the ground pattern cross approximately at right angles.

4. The antenna device for a high frequency radio apparatus of claim 1, wherein the shape of the antenna element is inverted-F, and the length of the antenna element is approximately a quarter wave length of a radio frequency used by the radio apparatus.

5. An antenna device for a high frequency radio apparatus comprising:

a multilayer circuit board;

an antenna element formed as a pattern on a layer of the multilayer circuit board; and a ground pattern that is connected with the antenna element and is formed in almost the entire area of any one internal layer of the multilayer circuit board other than the corresponding area that the antenna element occupies.

6. The antenna device for a high frequency radio apparatus of claim 5, wherein the shape of the antenna element is inverted-F, and the length of the antenna element is approximately a quarter wave length of a radio frequency used by the radio apparatus.

7. An antenna device for a high frequency radio apparatus comprising:

a multilayer circuit board;

an antenna element formed as a pattern on a layer of the multilayer circuit board;

a first ground pattern formed on a layer of the multilayer circuit board a constant distance from the antenna element and connected with the antenna element; and a second ground pattern electrically connected with the first ground pattern and formed in almost the entire area of any one internal layer of the multilayer circuit board other than the corresponding area that the antenna element occupies.

8. The antenna device for a high frequency radio apparatus of claim 7, wherein the shape of the antenna element is inverted-F, and the length of the antenna element is approximately a quarter wave length of a radio frequency used by the radio apparatus.

9. A high frequency radio apparatus comprising:

an antenna part comprising;

a multilayer circuit board having a curved periphery;

an antenna element formed as a pattern on a layer of the multilayer circuit board and having a near-arc shape along the periphery of the multilayer circuit board when viewed from above;

a ground pattern connected with the antenna element and formed in almost the entire area of any one internal layer of the multilayer circuit board other than the corresponding area that the antenna element occupies; and wherein a first line and a second line form an angle less than or equal to 180 degrees, the first line passing through the center of a circle formed in part by the near arc shape and a connecting point where the antenna element is connected with the ground pattern, and the second line going through the center of the circle and a tip of the antenna element; and a radio communication part that performs radio communication through the antenna part.

10. The high frequency radio apparatus of claim 9, wherein the ground pattern is formed on the board a constant distance from the antenna element.

11. The high frequency radio apparatus of claim 9, wherein a direction along an extension of the antenna element near the point where the antenna element is connected with the ground pattern and a tangent line at a periphery of the ground pattern where the antenna element is connected with the ground pattern cross approximately at right angles.

12. The high frequency radio apparatus of claim 9, wherein the shape of the antenna element is inverted-F, and the length of the antenna element is approximately a quarter wave length of a radio frequency used by the radio apparatus.

13. The high frequency radio apparatus of claim 9, further comprising a wrist watch-type case that stores the antenna part and the radio communication part.

14. A high frequency radio apparatus comprising:

an antenna part comprising:

a multilayer circuit board;

an antenna element formed as a pattern on a layer of the multilayer circuit board; and a ground pattern connected with the antenna element and formed in almost the entire area of any one internal layer of the multilayer circuit board other than the corresponding area that the antenna element occupies; and a radio communication part that performs radio communication through the antenna part.

15. The high frequency radio apparatus of claim 14, wherein the radio communication part comprises a plurality of parts including an electric power source, and when placing parts near the antenna part affects characteristics of the antenna part, the parts are placed so that an orthogonal projection of the parts projected on the ground pattern fit in the ground pattern.

16. The high frequency radio apparatus of claim 14, wherein the shape of the antenna element is inverted-F, and the length of the antenna element is approximately a quarter wave length of a radio frequency used by the radio apparatus.

17. The high frequency radio apparatus of claim 14, further comprising a wrist watch-type case that stores the antenna part and the radio communication part.

18. A high frequency radio apparatus comprising:

an antenna part comprising:

a multilayer circuit board;

an antenna element formed as a pattern on a layer of the multilayer circuit board; and a first ground pattern connected with the antenna element and formed on a layer of the multilayer circuit board at a constant distance from the antenna element;

a second ground pattern electrically connected with the first ground pattern and formed in almost the entire area of any one internal layer of the multilayer circuit board other than the corresponding area that the antenna element occupies; and a radio communication part that performs radio communication through the antenna part.

19. The high frequency radio apparatus of claim 18, wherein the radio communication part comprises a plurality of parts including an electric power source, and when placing parts near the antenna part affects characteristics of the antenna part, the parts are placed so that an orthogonal projection on the parts projected on the second ground pattern fit in the second ground pattern.

20. The high frequency radio apparatus of claim 18, wherein the shape of the antenna element is inverted-F, and the length of the antenna element is approximately a quarter wave length of radio frequency used with the radio apparatus.

21. The high frequency radio apparatus of claim 18, further comprising a wrist watch-type case that stores the antenna part and the radio communication part.

* * * * *